United States Patent [19]

Classen

[11] 4,279,104

[45] Jul. 21, 1981

[54] SIGN POST CONSTRUCTION HAVING RECIPROCABLE DRIVER FOR PLACEMENT AND REMOVAL

[76] Inventor: Alvin T. Classen, 1403 Roach St., Norfolk, Nebr. 68701

[21] Appl. No.: 68,783

[22] Filed: Aug. 22, 1979

[51] Int. Cl.[3] ..... E02D 5/74; G09F 7/18

[52] U.S. Cl. ..... 52/38; 52/165; 52/298

[58] Field of Search ..... 52/38, 40, 156, 165, 52/697, 721, 726, 297, 298; 40/606, 607, 617; 403/3, 172, 246; 256/DIG. 5, 21

[56] References Cited

U.S. PATENT DOCUMENTS

| | | | |
|---|---|---|---|
| 3,143,817 | 8/1964 | Paulson | 40/606 |
| 3,508,731 | 4/1970 | Jablonski | 52/40 |
| 3,603,628 | 7/1971 | Smith et al. | 403/172 |
| 4,120,125 | 10/1978 | Cvetan | 52/156 |

FOREIGN PATENT DOCUMENTS

| | | | |
|---|---|---|---|
| 2343877 | 7/1977 | France | 256/DIG. 5 |

*Primary Examiner*—James L. Ridgill
*Attorney, Agent, or Firm*—Sughrue, Mion, Zinn, Macpeak and Seas

[57] ABSTRACT

A hollow post tube 12 is reciprocable on an anchor spike 14 to implement the placement and removal of a sign post. A striker plate 20 located on the bottom of the post tube may be repeatedly hammered down against a ground abutment plate 16 or up against an impact plate 18, both secured on the anchor spike, to drive the anchor spike into or out of the ground. Planar ears 22 secured to the spike below the ground abutment plate prevent the spike from turning in situ, and the post tube and impact plate are cooperably square in section to prevent the tube from rotating on the spike. A sign carrying cross bar 24 is removably mounted in the open upper end of the post tube by a releasable spring detent strap 36 rigidly secured to a mounting tube 34.

5 Claims, 3 Drawing Figures

FIG. 1
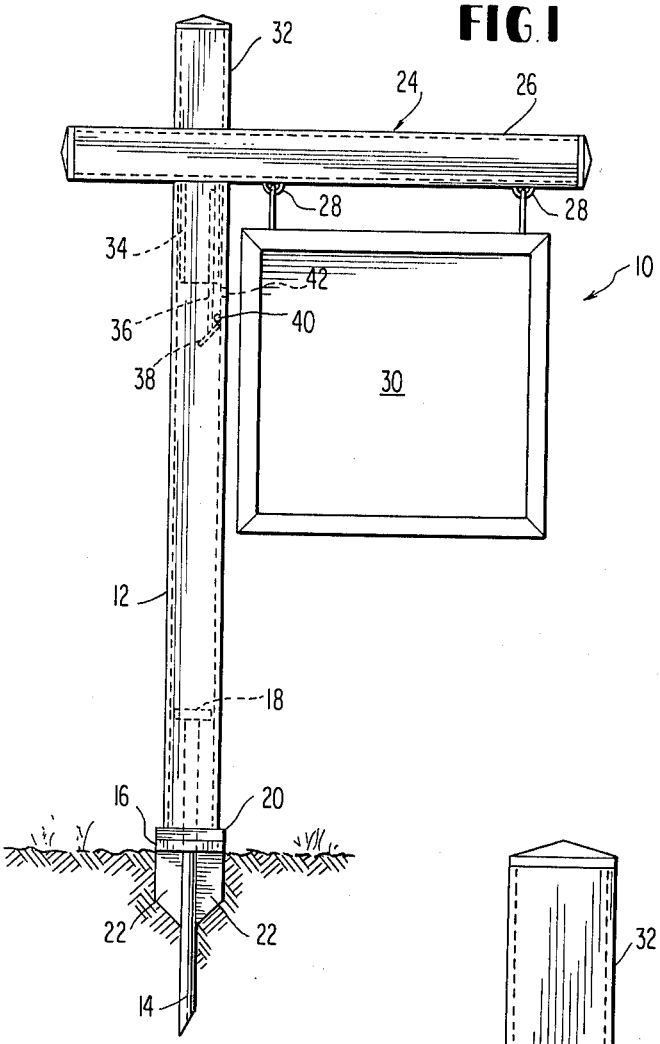
FIG. 2
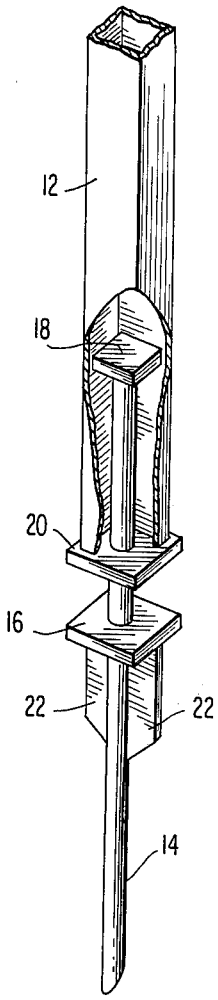
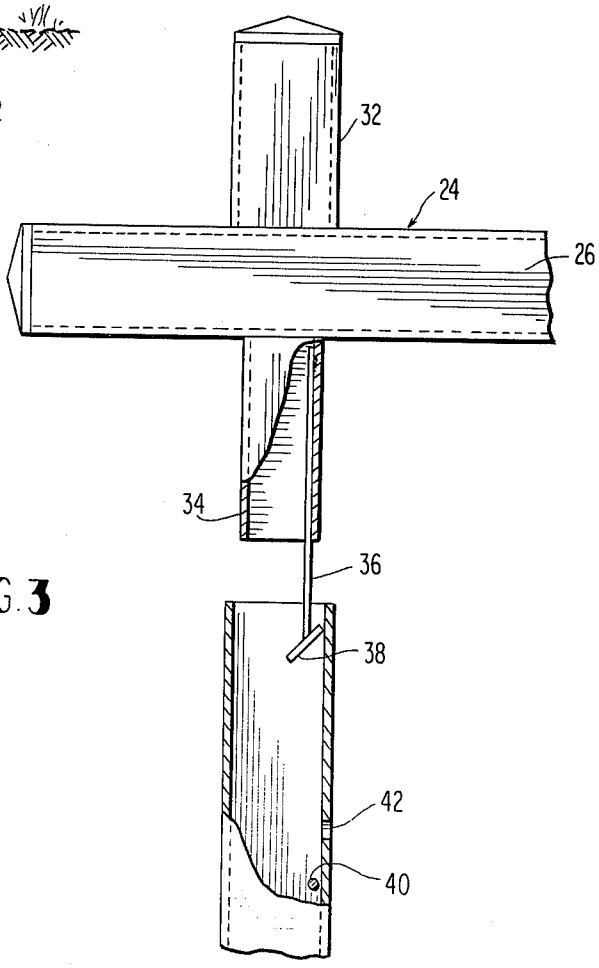
FIG. 3

SIGN POST CONSTRUCTION HAVING RECIPROCABLE DRIVER FOR PLACEMENT AND REMOVAL

BACKGROUND OF THE INVENTION (1) Field of the Invention

This invention relates to a sign post having a vertical tubular member reciprocably mounted on a ground spike to implement the placement and removal of the overall post.

(2) Description of the Prior Art

U.S. Pat. No. 3,143,817, issued to Paulson on Oct. 11, 1964, represents the closest prior art known to applicant, and basically teaches a sign holder construction wherein a tubular upper sleeve 14 having a welded top plug 16 serves as a reciprocable hammer to drive an anchor stake 10 having an upper shaft head 13 into the ground. Rotation is prevented by a triangular plate 12, and by a lower sign bracket 18 being welded directly to the stake 10. The disadvantages of this construction include the tubular upper sleeve and its end closure plugs not having sufficient weight to implement the effecient driving of the anchor stake, particularly when the ground is hard or frozen, and the fact that the rotation of the tubular sleeve relative to the anchor stake is only restrained by the presence of the mounted sign, which can easily damage or dislodge the latter in the event of high winds.

SUMMARY OF THE INVENTION

These drawbacks and disadvantages attendant with the prior art are effectively overcome by the sign post construction of the present invention, according to which a hollow main post tube or sleeve is slidably mounted on an elongated anchor stake or spike having a horizontal ground abutment plate rigidly secured thereto proximate its mid-section and an impact plate attached to its upper end. The post tube is provided with a centrally apertured striker plate secured to its bottom end intermediate the ground abutment and impact plates, which also serves to retain the post tube and anchor spike in an assembled condition. The post tube is thus reciprocably movable on the anchor spike in the manner of an impact hammer, whereby the striker plate may be repeatedly driven down against the ground abutment plate or up against the impact plate to implement the placement of the anchor spike into the ground or its removal therefrom, respectively.

The rotation of the assembly is prevented by planar ears secured to the ground spike just below the abutment plate, and by the hollow post tube and the impact plate disposed within it being cooperably square in cross-section.

A sign carrying horizontal cross bar is removably mounted in the open upper end of the post tube by a spring detent strap, whereby a partial disassembly may be had to implement handling and transportation from one site to another.

BRIEF DESCRIPTION OF THE DRAWINGS

In the drawings:

FIG. 1 shows an elevation view of an assembled sign post constructed in accordance with the teachings of the present invention in situ in the ground;

FIG. 2 shows a perspective view, partly cut away, of the lower portion of the post tube and anchor spike; and FIG. 3 shows an elevation view of the upper portion of the post tube and cross bar, partly in section.

DETAILED DESCRIPTION OF THE PREFERRED EMBODIMENT

Referring now to the drawings, a sign post assembly 10 includes, as its three main components, a hollow post tube 12, an anchor stake or spike 14 slidably fitted into the lower end of the post tube, and a cross bar unit 24 removably mounted in the open upper end of the post tube. The anchor spike has a ground abutment plate 16 rigidly secured thereto by welding or the like proximate its mid-section, below which are provided one or more planar, vertically oriented ears 22 welded or otherwise rigidly secured to the spike and/or the abutment plate to prevent the spike from twisting in the ground. An impact plate 18 is welded to the top of the anchor spike, and the bottom of the post tube is closed by a centrally apertured striker plate 20 through which the anchor spike extends into the interior of the post tube. The hollow post tube 12 is preferably square in cross-section, and the impact plate 18 is also square but of slightly smaller dimensions to enable it to freely slide within the post tube. This prevents the post tube from turning or rotating relative to the anchor spike, and at the same time maintains these two components in axial alignment and prevents any tipping or tilting of the post tube. As is obvious, the main post tube and impact plate need not be square in cross-section but may have other mating configurations which prevent their relative rotation, i.e., rectangular, oval, etc. The ground abutment plate 16 and striker plate 20 are also preferably square, but here again other shapes may be employed since these elements do not implement any rotation prevention function.

The cross bar unit 24 includes a horizontal tube 26, preferably made from the same stock as the main post tube 12 and fitted with end caps for aesthetic appeal and to prevent the entry of rainwater and the like, having a spaced pair of eye members 28 from which a sign 30 may be hung. A capped upper tube extension 32 is welded to the tube 26 adjacent one end thereof, again preferably made from the same stock as the main post and horizontal tubes 12, 26, and a hollow lower mounting tube 34 is welded just below the upper tube extension and depends vertically downward. The mounting tube 34 is of slightly smaller dimensions than the main post tube 12, and is configured to be removably insertable in the open upper end of the latter to a depth at which the horizontal tube 26 rests on the top of the main post tube.

A spring detent strap 36 is welded at its upper end to the inside of the mounting tube 34, extends out of the open lower end thereof, and terminates in an angled latch plate 38 which may be separately welded to the end of the strap 36 or formed by the reverse bending of the strap. The latch plate 38 cooperates with a horizontal pin 40 that extends through the hollow interior of the main post tube closer to one side thereof, and a release aperature 42 is provided in the side of the post tube just above the pin 40.

In use, the main post tube 12 is manually reciprocated within the limits of its travel to repeatedly and forceably impact the striker plate 20 against the ground abutment plate 16 until the anchor spike 14 and ears 22 have been vertically driven into the ground until the abutment plate 16 is flush with the surface. The mounting tube 34 of the cross bar unit is thereafter inserted into the open upper end of the main post tube until the latch plate 38 engages the pin 40, is initially cammed or deflected thereby towards the center of the main post tube, and thereafter snaps back underneath the pin to thus latch the cross bar unit in its assembled state within the main post tube.

To remove the sign post for transport and relocation, a pencil or other rod-like article is inserted through the release aperture 42 to bend the spring detent strap 36 inwardly to a sufficient extent for the latch plate 38 to clear the horizontal pin 40. With the detent strap thus depressed, the cross bar unit is simply lifted out of the main post tube. The post tube 12 is thereafter manually reciprocated in an upward manner to repeatedly hammer the striker plate 20 against the impact plate 18 until the anchor spike becomes unseated and pulls clear of the ground.

As will be obvious to those skilled in the art, a number of variations and modifications of the embodiment described above are possible without departing from the spirit or scope of the invention. For example, the horizontal tube 26 and decorative upper tube extension 32 may be entirely dispensed with, and the sign attached directly to an extension of the mounting tube 34. Similarly, to support extremely heavy signs two main post tube assemblies may be employed with the cross bar unit 24 mounted between them. Further, although welding has been mentioned as a preferred fabrication technique, the various components may also be made by integral molding, secured together by conventional nuts and bolts, etc.

What is claimed is:

1. A sign post construction, comprising:

(a) a central apertured ground abutment plate (16), (b) an elongated anchor spike (14) extending through the ground abutment plate aperture and rigidly secured thereto at a position intermediate its length, (c) an impact plate (18) rigidly and centrally secured to the top of the anchor spike, (d) a hollow post tube (12) slidably disposed over the impact plate and anchor spike, (e) a centrally apertured spiker plate (20) rigidly secured to and closing a lower end of the post tube, the anchor spike slidably extending through the striker plate aperture and the striker plate being disposed intermediate the ground abutment and impact plates such that the striker plate may be manually reciprocatingly driven downwardly, via the hollow post tube, against the ground abutment plate to drive the anchor spike into the ground, and upwardly against the impact plate to remove the anchor spike from the ground, (f) the post tube and impact plate having complementary, non-circular cross-sections to prevent the post tube from rotating relative to the anchor spike, and (g) sign carrying means removably mounted to the post tube.

2. Sign post construction as defined in claim 1, further comprising at least one vertically oriented planar ear rigidly secured to the anchor spike to prevent it from rotating in the ground.

3. Sign post construction as defined in claims 1 or 2, wherein the sign carrying means comprises a mounting tube dimensioned to be slidably insertable in an open upper end of the post tube, and means for releasably latching the mounting tube to the post tube.

4. Sign post construction as defined in claim 3, wherein the releasable latching means comprises a spring detent strap having one end extending within and rigidly secured to the mounting tube, having its other end extending out of the mounting tube and terminating in an angled latch plate, and a cooperating pin member extending horizontally through the hollow interior of the post tube, whereby the latch plate is inwardly deflected toward the center of the post tube by the pin member during the insertion of the mounting tube, and thereafter springs back to latch the mounting tube to the post tube.

5. A sign post construction as defined in claim 4, further comprising an aperture in a side of the post tube just above the pin member, through which a release implement may be inserted to engage and inwardly deflect the spring detent strap and latch plate.

* * * * *